US012778307B2

(12) United States Patent
Brottlund et al.

(10) Patent No.: US 12,778,307 B2
(45) Date of Patent: Nov. 3, 2026

(54) ADJUSTABLE BED BASE HAVING MULTIPLE PIECE HEADBOARD

(71) Applicant: L&P Property Management Company, South Gate, CA (US)

(72) Inventors: Von W. Brottlund, Pierce City, MO (US); Jacob J. Neuenswander, Carthage, MO (US); Dustin W. Smith, Carthage, MO (US); Jacob Shields, Lamar, MO (US); Daniel W. Williams, Webb City, MO (US)

(73) Assignee: L&P Property Management Company, Carthage, MO (US)

( * ) Notice: Subject to any disclaimer, the term of this patent is extended or adjusted under 35 U.S.C. 154(b) by 0 days.

(21) Appl. No.: 18/967,791

(22) Filed: Dec. 4, 2024

(65) Prior Publication Data

US 2026/0150972 A1 Jun. 4, 2026

(51) Int. Cl.
*A47C 20/04* (2006.01)
*A47C 19/02* (2006.01)

(52) U.S. Cl.
CPC ..... *A47C 20/041* (2013.01); *A47C 19/02* (2013.01)

(58) Field of Classification Search
CPC ..... A47C 20/041; A47C 19/02
USPC ..... 5/42.1, 613
See application file for complete search history.

(56) References Cited

U.S. PATENT DOCUMENTS

| | | | | |
|---|---|---|---|---|
| 2010/0071132 | A1* | 3/2010 | Barthelt | A61G 7/16 5/613 |
| 2014/0041121 | A1* | 2/2014 | Shan | A47C 21/006 5/618 |
| 2019/0142177 | A1* | 5/2019 | Brown | A47C 20/041 5/618 |
| 2019/0191890 | A1* | 6/2019 | Huang | A47C 20/10 |
| 2020/0397147 | A1* | 12/2020 | Ren | A47C 19/021 |
| 2024/0285084 | A1* | 8/2024 | Wang | A61G 7/018 |

* cited by examiner

*Primary Examiner* — Myles A Throop
(74) *Attorney, Agent, or Firm* — Wood Herron & Evans LLP

(57) ABSTRACT

An adjustable bed base has a stationary frame and a stationary seat deck. An articulating deck includes inner and outer head deck members. A linear actuator inclines and declines the inner and outer head deck members relative to a stationary seat deck member using a plurality of links. When the linear actuator is extended, the outer and inner head deck members separate from the stationary seat deck member and from each other.

15 Claims, 17 Drawing Sheets

ADJUSTABLE BED BASE HAVING MULTIPLE PIECE HEADBOARD

FIELD OF THE INVENTION

This invention relates generally to bedding products and, more particularly, to a motorized adjustable bed base.

BACKGROUND OF THE INVENTION

Conventional adjustable bed bases often have a stationary frame supported by leg assemblies. Such adjustable bed bases typically include a deck supported by the stationary frame. The deck supports a mattress. The deck usually comprises multiple deck members hinged together to form an articulated deck. One of the deck members, commonly a seat deck member, is commonly fixedly secured to the stationary frame. A head deck member is typically hinged to the seat deck member. A first motorized linear actuator inclines the front end of the head deck member so a user may sit up and read or watch television in an inclined position.

One drawback to such common adjustable bed bases is that inclination of the head deck member of the articulated deck creates a sharp angle between the head deck member and the stationary seat deck member. Consequently, a mattress supported by the articulated deck forces a person lying on the mattress into an uncomfortable position in which the person's upper back is in an unnatural position.

Persons who articulate the head deck member relative to the stationary seat deck member desire a softer or larger angle between the head and seat deck members of the deck. Other health conditions or situations may require that a person's head be at a different position than possible with current adjustable bed bases.

In view of the above, there is a need for an adjustable bed base having a head deck member which comprises two pieces, at least one of which is movable relative to the other.

There is further a need for an adjustable bed base having a head deck member which allows a gentle bending motion of the mattress during articulation of the head deck member of the adjustable bed base.

It is therefore an objective of this invention to provide an adjustable bed base having a multiple piece head deck which allows the adjustable bed base to assume certain desirable positions.

It is further an objective of this invention to provide an adjustable bed base having an articulated deck comprising a multiple piece head member, the pieces being able to separate from each other via a motorized linear actuator to allow the deck to assume a selected position.

SUMMARY OF THE INVENTION

According to one aspect of the invention, an adjustable bed base comprises a generally rectangular stationary frame having opposed side rails, a head rail and a foot rail. Legs which may or may not be adjustable in height are secured to the stationary frame for supporting the stationary frame. The adjustable bed base further comprises a cross rail extending between the opposed side rails of the stationary frame.

The adjustable bed base further comprises a slotted guide member secured to each of the opposed side rails of the stationary frame. Each of the slotted guide members has a slot extending along the length thereof.

The adjustable bed base further comprises an articulated deck comprising an outer head deck member, an inner head deck member and a seat deck member. The seat deck member is secured to the opposed side rails of the stationary frame and is stationary regardless of the positions of the head deck members. The seat deck member may be one or two pieces. In one embodiment, each of the deck members is a solid member made of either wood or plastic.

The adjustable bed base further comprises two spaced short tubes secured to the inner head deck member. The short tubes extend parallel the side rails of the stationary frame. The adjustable bed base further comprises two spaced long tubes secured to the outer head deck member. The long tubes extend parallel the side rails of the stationary frame.

The adjustable bed base further comprises a double slotted link welded to each of the short tubes. Each double slotted link has a first slot and a second slot. However, the double slotted link may be secured to the short tube in any known manner.

The adjustable bed base further comprises a stationary guide secured to each of the slotted guide members. Each of the stationary guides extends through the second slot of one of the double slotted link.

The adjustable bed base further comprises a linear actuator for inclining the outer and inner head deck members from their home positions in which they are horizontal and aligned with the stationary seat deck member. The linear actuator is pivotally secured to a first mounting bracket secured to the cross rail at one end and is pivotally secured to a second mounting bracket secured to a drive tube at the second end.

The adjustable bed base further comprises a drive link welded to each end of the drive tube. A first end of the drive link is pivotally secured to a connecting link. A second end of the drive link is secured to one of the long tubes.

The adjustable bed base further comprises a drag link pivotally secured at a first end to one of the side rails of the stationary frame. The drag link is also secured at a second end to one of the double slotted links with a riding fastener. The riding fastener extends through the first slot of the double slotted link.

The adjustable bed base further comprises an extension link pivotally secured to one of the slotted guide members with an extension fastener which extends though the slot of the slotted member. The extension link is welded to one of the long tubes. The connecting link has a first end secured to the first end of the drive link and a second end secured to the drag link.

The adjustable bed base further comprises a control system which controls movement of the linear actuator. The linear actuator is preferably motorized.

Worded another way, the adjustable bed base comprises a stationary frame having opposed side rails, a head rail and a foot rail. Legs, which may or may not be adjustable in height, support the stationary frame. The adjustable bed base further comprises a cross rail extending between the opposed side rails of the stationary frame.

The adjustable bed base further comprises a slotted guide member secured to each of the opposed side rails of the stationary frame. Each of the slotted guide members has a slot extending therethrough.

The adjustable bed base further comprises an articulated deck comprising an outer head deck member, an inner head deck member and a seat deck member. The seat deck member is secured to the stationary frame and is stationary regardless of the positions of the head deck members. The seat deck member may be one or two pieces. In some embodiments, each of the deck members is a solid member made of either wood or plastic.

The adjustable bed base further comprises two spaced short tubes secured to the inner head deck member. The short tubes extend parallel the side rails of the stationary frame. The adjustable bed base further comprises two spaced long tubes secured to the outer head deck member. The long tubes extend parallel the side rails of the stationary frame.

The adjustable bed base further comprises a double slotted link secured to each of the short tubes. Each double slotted link has a forward slot and a rear slot. In one preferred embodiment, the double slotted link is welded to the short tube. However, the double slotted link may be secured to the short tube in any known manner.

The adjustable bed base further comprises a stationary guide secured to each of the slotted guide members. Each of the stationary guides extends through the rear slot of one of the double slotted link.

The adjustable bed base further comprises a linear actuator for inclining the outer and inner head deck members from their home positions in which they are horizontal and aligned with the stationary seat deck member. The linear actuator is secured to a first mounting bracket secured to the cross rail at one end and is secured to a second mounting bracket secured to a drive tube at the second end.

The adjustable bed base further comprises a drive link welded to each end of the drive tube. A first end of the drive link is pivotally secured to a connecting link. A second end of the drive link is secured to one of the long tubes.

The adjustable bed base further comprises a drag link pivotally secured at a first end to one of the side rails of the stationary frame. The drag link is also secured at a second end to one of the double slotted links with a riding fastener. The riding fastener extends through the front slot of the double slotted link.

The adjustable bed base further comprises an extension link pivotally secured to one of the slotted guide members with an extension fastener which extends though the slot of the slotted member. The extension link is secured to one of the long tubes, preferably via welding. The connecting link has a first end secured to the first end of the drive link and a second end secured to the drag link. The double-slotted links, the drive links, the connecting links, the drag links and the extension links are non-linear. The double-slotted links, the drive links, the connecting links and the drag links are non-planar.

The adjustable bed base further comprises a control system which controls movement of the linear actuator.

According to another aspect of the present invention, a method of raising a head portion of an adjustable bed base is provided. The method comprises providing an adjustable bed base as described above. The method further comprises activating the linear actuator to move the drive tube away from the cross rail, each of the extension fasteners moving inside one of the slots of the slotted guide members. During such movement of the extension fasteners, the extension links move too. The method further comprises moving the double slotted links due to movement of the outer head deck member and attached long tubes. The stationary guides stay inside the second or rear slots of the double slotted links. After the stationary guides reach the ends of the second or rear slots of the double slotted links, the drag links pivot so the riding fasteners move forwardly in the first or front slots of the double slotted links. This movement causes separation between the outer and inner head deck members. The step of moving the drive tube away from the cross rail further comprises raising the drive tube relative to its home position.

According to another aspect of the present invention, a method of raising a head portion of an adjustable bed base is provided. The method comprises providing an adjustable bed base including a stationary frame having opposed side rails, a head rail, a foot rail and a cross rail extending between the opposed side rails of the frame. The adjustable bed base further comprises a slotted guide member secured to each of the side rails of the stationary frame. Each slotted guide member has a slot extending along a length thereof. Upon activation of the motorized linear actuator, extension fasteners at the end of extension links move along the slots of the slotted guide members. The adjustable bed base further comprises an articulating deck comprising an outer head deck member, an inner head deck member and a stationary seat deck member. The stationary seat deck member is secured to the stationary frame. The adjustable bed base further comprises a motorized linear actuator for moving the outer and inner head deck members forwardly relative to the stationary seat deck member and inclining the outer and inner head deck members relative to the stationary seat deck member. The method further comprises activating the motorized linear actuator to simultaneously incline the outer and inner head deck members until the inner head deck member is in its final position; and further inclining the outer deck member while the inner deck member is in its final position. The method further comprises simultaneously moving forward the outer and inner head deck members until the inner deck member is in its final position and further moving the outer deck member forward while the inner deck member is in its final position.

The accompanying drawings, which are incorporated in and constitute a part of this specification, illustrate embodiments of the invention and, together with the summary of the invention given above, and the detailed description of the drawings given below, explain the principles of the present invention.

BRIEF DESCRIPTION OF THE DRAWINGS

FIG. 7AA is a side schematic view, partially in cross-member, of a portion of the adjustable bed base of FIG. 7 in a home position.

FIG. 7BB is a side schematic view, partially in cross-member, of a portion of the adjustable bed base of FIG. 7B.

FIG. 7CC is a side schematic view, partially in cross-member, of a portion of the adjustable bed base of FIG. 7C.

FIG. 7DD is a side schematic view, partially in cross-member, of a portion of the adjustable bed base of FIG. 7D.

DETAILED DESCRIPTION OF THE INVENTION

Figure 1:
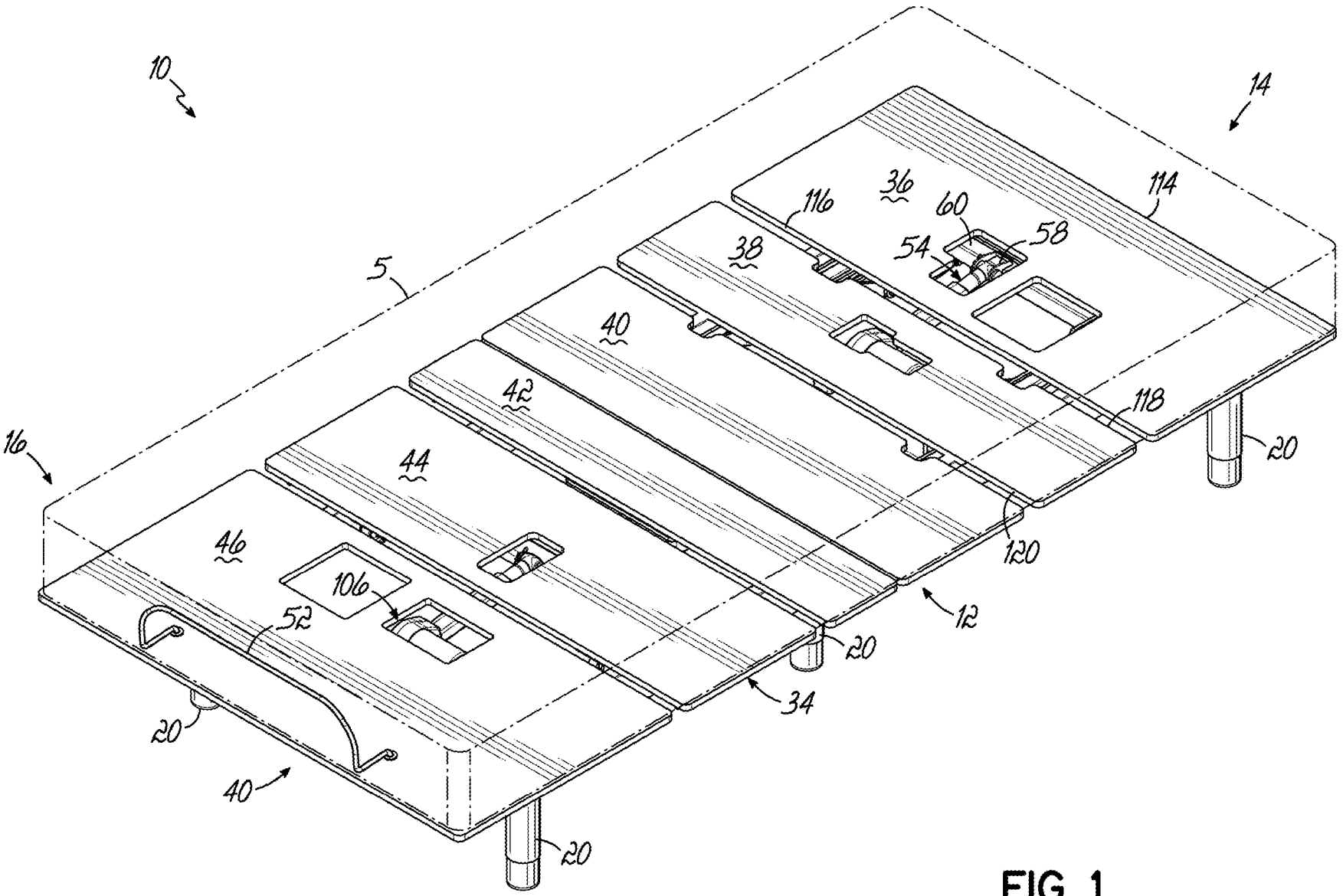
FIG. 1 is a top perspective view of an adjustable bed base.

Referring to FIG. 1, an adjustable bed 10 includes an adjustable bed base 12 for supporting a mattress 5. The adjustable bed base 12 has a head end 14 and a foot end 16. The adjustable bed base 12 of the present invention may be used with any type of mattress. The mattress is not intended to be limited by the drawings.

Figure 2:
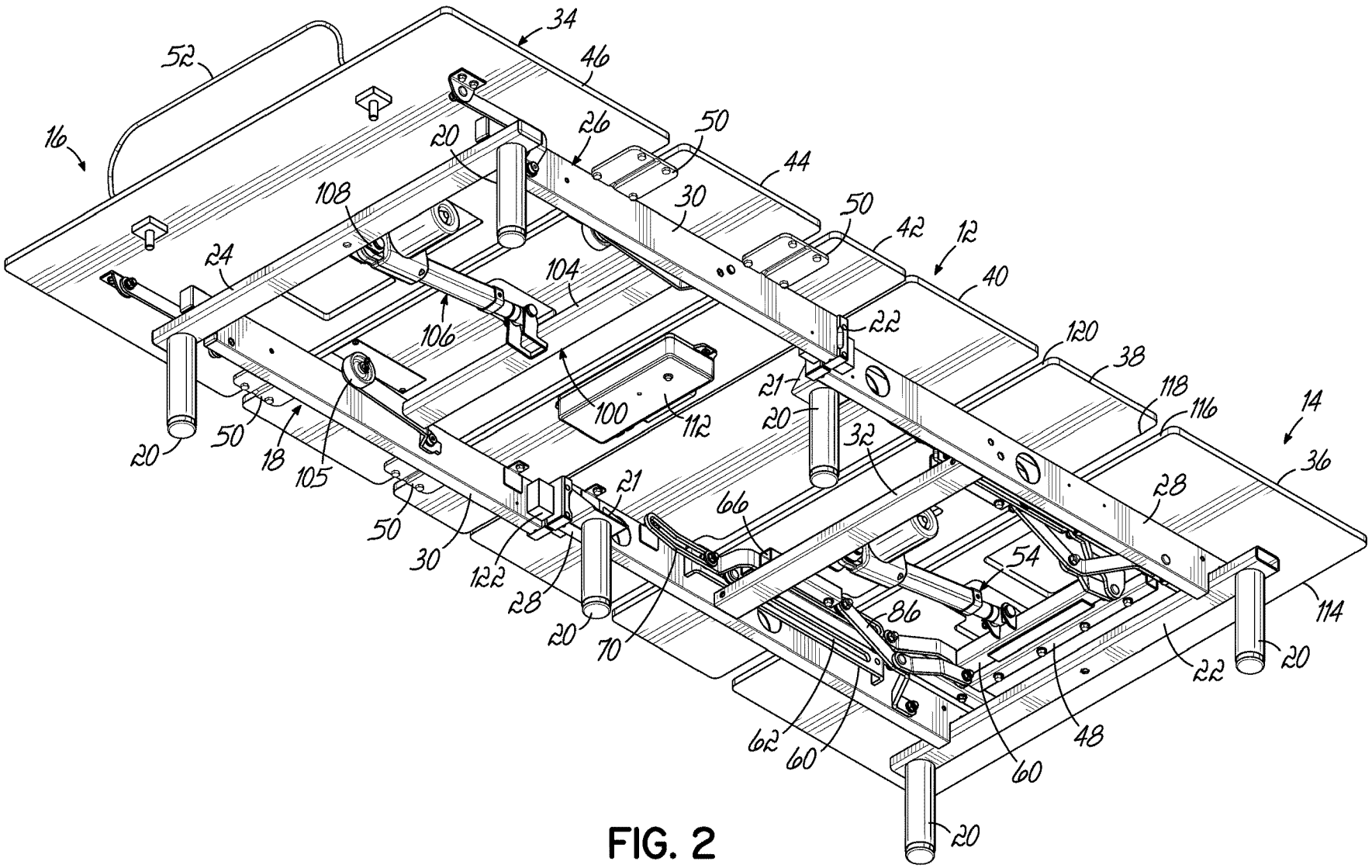
FIG. 2 is a bottom perspective view of the adjustable bed base of FIG. 1.

As best shown in FIG. 2, the adjustable bed base 12 comprises a generally rectangular stationary frame 18 supported by leg assemblies or legs 20. The leg assemblies 20 are illustrated as being adjustable in height. Although one type of leg assembly 20 is illustrated supporting the adjustable bed base 12, any other type of leg assembly including unitary legs not adjustable in height may be used in accordance with the present invention. The legs of the adjustable bed base are not intended to be limited by the drawings.

Figure 4A:
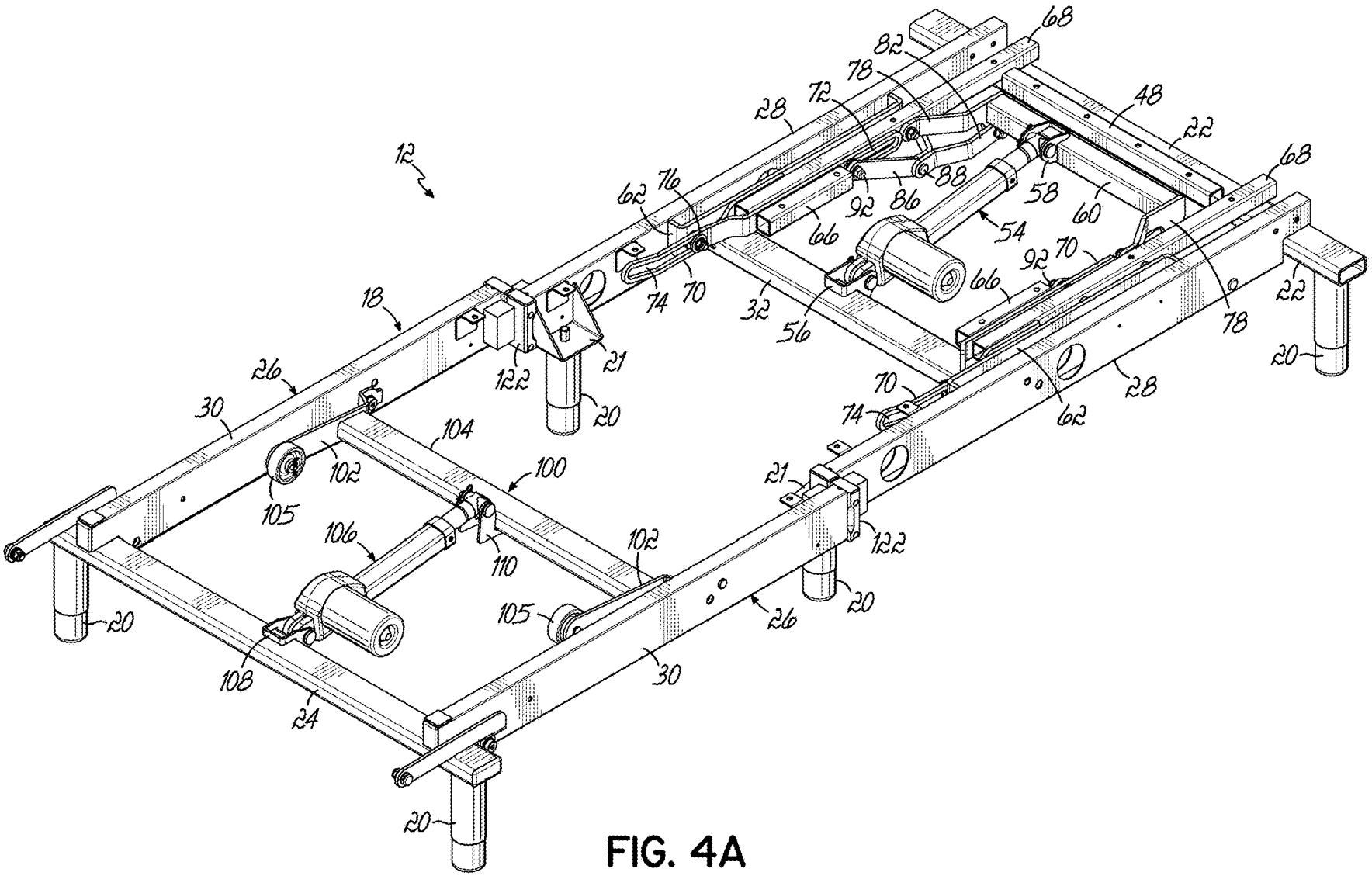
FIG. 4A is a perspective view of a portion of the adjustable bed base of FIG. 1.
Figure 11:
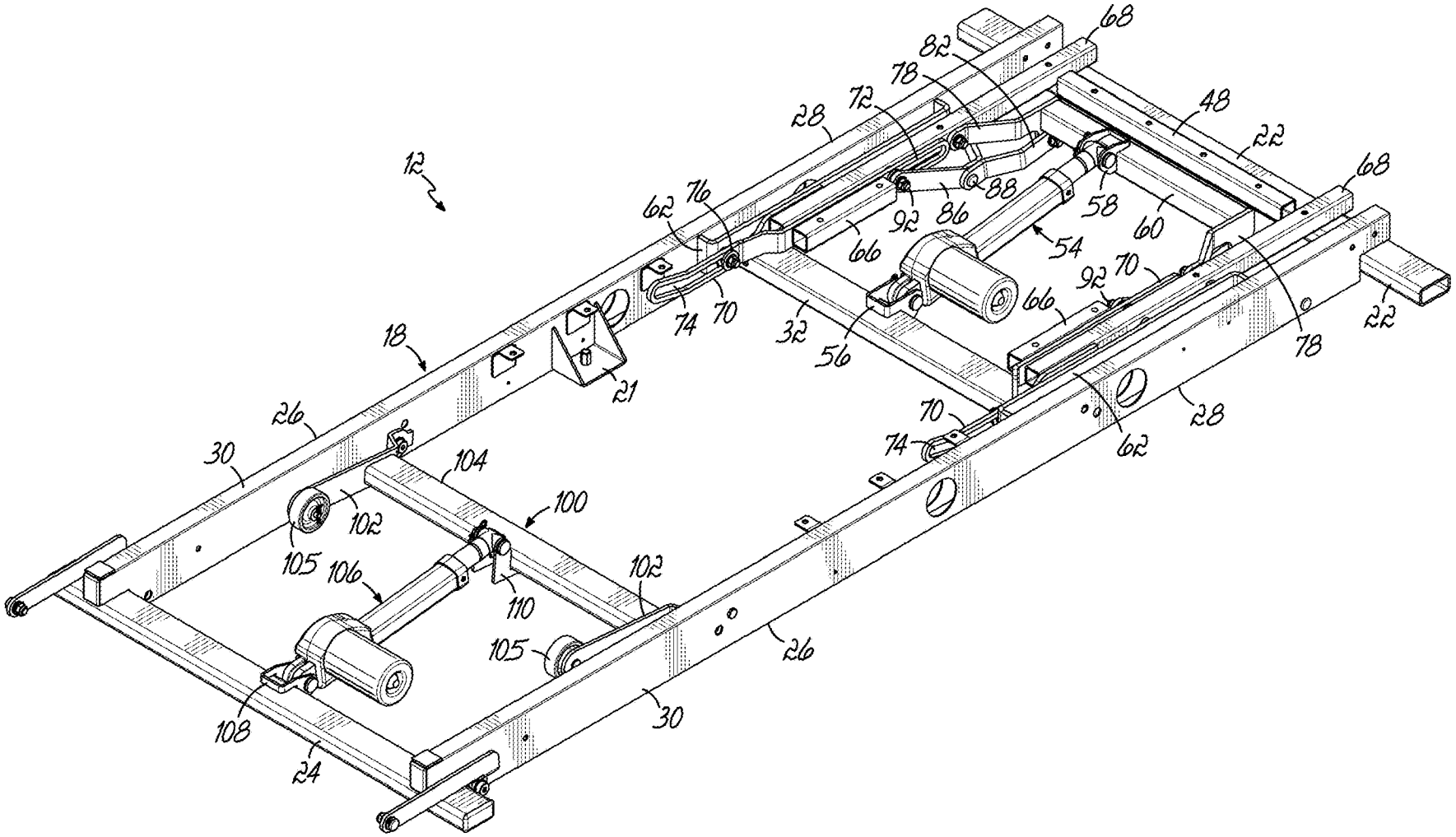
FIG. 11 is a perspective view of a portion of an alternative embodiment of adjustable bed base.

As best shown in FIG. 4A, the generally rectangular stationary frame 18 comprises a head rail 22, a foot rail 24 and two opposed side rails 26. The head rail 22 and foot rail 24 each extends between the opposed foldable side rails 26. Each of the side rails 26 is foldable at a hinge 122 and comprises a front member 28 and a rear member 30. Although the drawings show the head, foot and side rails 22, 24 and 26, respectively, each having a hollow interior and being a certain size and/or shape, the drawings are not intended to be limiting. For example, the opposed side rails need not be foldable, they may be non-foldable, as shown in FIG. 11.

As shown in the drawings, each of two middle legs 20 is secured to a mounting bracket 21 which is welded or otherwise to one of the front members 28 of one of the side rails 26. Although not shown, each of two middle legs 20 may be secured to a mounting bracket 21 which is welded or otherwise to one of the rear members 30 of one of the side rails 26.

The stationary frame 18 further comprises a cross rail 32 secured to the side rails 26 of the stationary frame 18, cross rail 32 extending between the side rails 26 of the stationary frame 18. Although the drawings show the cross rail 28 having a hollow interior and being a certain size and/or shape, the drawings are not intended to be limiting. Although the stationary frame 18 is typically made of metal, it may be made of any known material.

Figure 3:
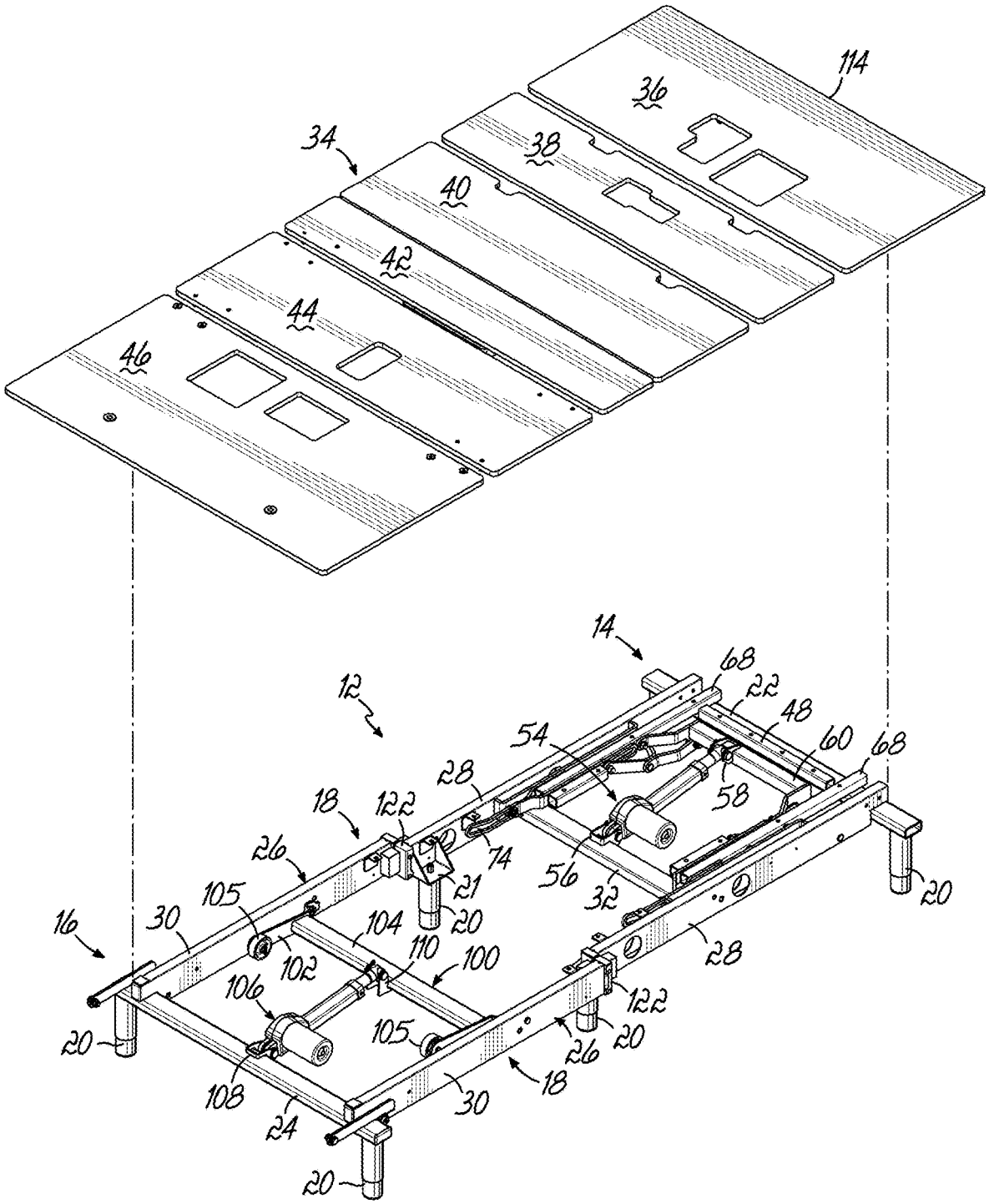
FIG. 3 is perspective view of the adjustable bed base of FIG. 1 showing the articulated deck separated from the remainder of the adjustable bed base.

As best shown in FIG. 3, the adjustable bed base 12 further comprises an articulating deck 34 comprising an outer head deck member 36, an inner head deck member 38, a front seat deck member 40, a rear seat deck member 42, a thigh deck member 44 and a foot deck member 46. The seat deck members 40, 42 are secured to the stationary frame 18 and do not move when the deck 40 is articulated. As best seen in FIG. 2, the rear seat deck member 42 is hinged to the thigh deck member 44 with hinges 50. Similarly, the foot deck member 46 is hinged to the thigh deck member 44 with hinges 50. Although the deck members 36, 38, 44 and 46 are shown being generally solid pieces with one or more openings therethrough, such openings may be different sizes or at different locations. The openings allow the deck members to lie flat or horizontal as shown in FIG. 1, the motors or other portions of the linear actuators extending partially through some of the openings. The drawings are not intended to be limiting.

Similarly, although the deck members 36, 38, 40, 42, 44 and 46 are illustrated being a certain size, the size of any of the deck members is not intended to be limited by the drawings. Although six deck members are illustrated, the deck may include any desired number of deck members which articulate relative to adjacent deck members. The number of deck members is not intended to be limited by the drawings.

As best shown in FIG. 1, a stop 52 is secured to the foot deck member 46 of the articulating deck 34 and functions to prevent movement of the mattress 5 relative to the adjustable bed base 12 when the articulating deck 34 is articulated.

As best shown in FIG. 4, the adjustable bed base 12 further comprises a motorized front linear actuator 54 for moving (inclining, declining and spacing) the outer and inner head deck members 36, 38. As best shown in FIG. 4, the motorized front linear actuator 54 has a rear or first end pivotally secured to a mounting bracket 56 welded or otherwise secured to the cross rail 32. The motorized front linear actuator 54 has a front or second end pivotally secured to a mounting bracket 58 welded or otherwise secured to drive tube 60. Although the mounting brackets 56, 58 are shown having certain shapes, either mounting bracket may be any other desired shape. Again, the drawings are not intended to be limiting.

Figure 5:
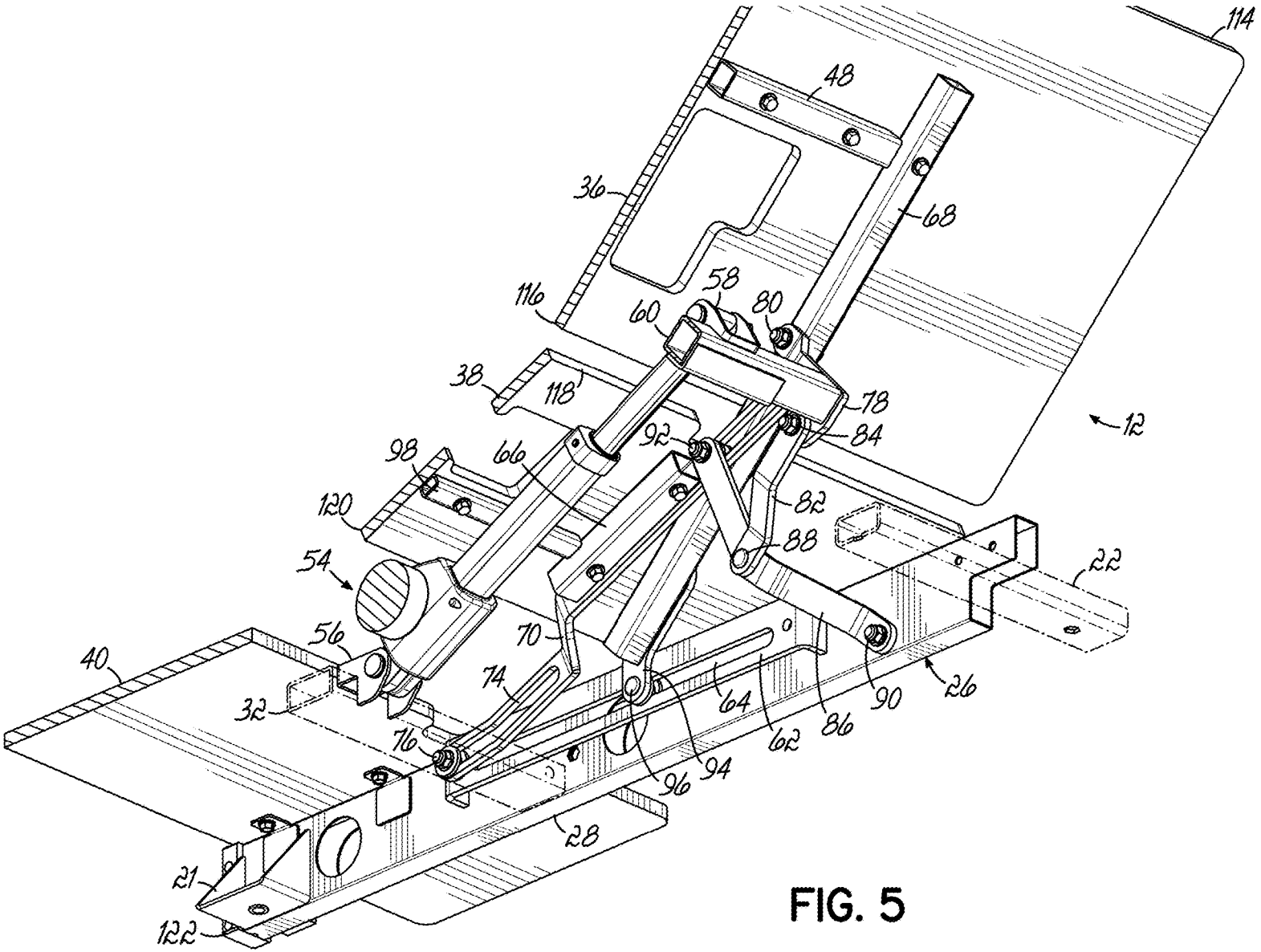
FIG. 5 is an enlarged perspective view of a portion of the adjustable bed base of FIG. 1.
Figure 6:
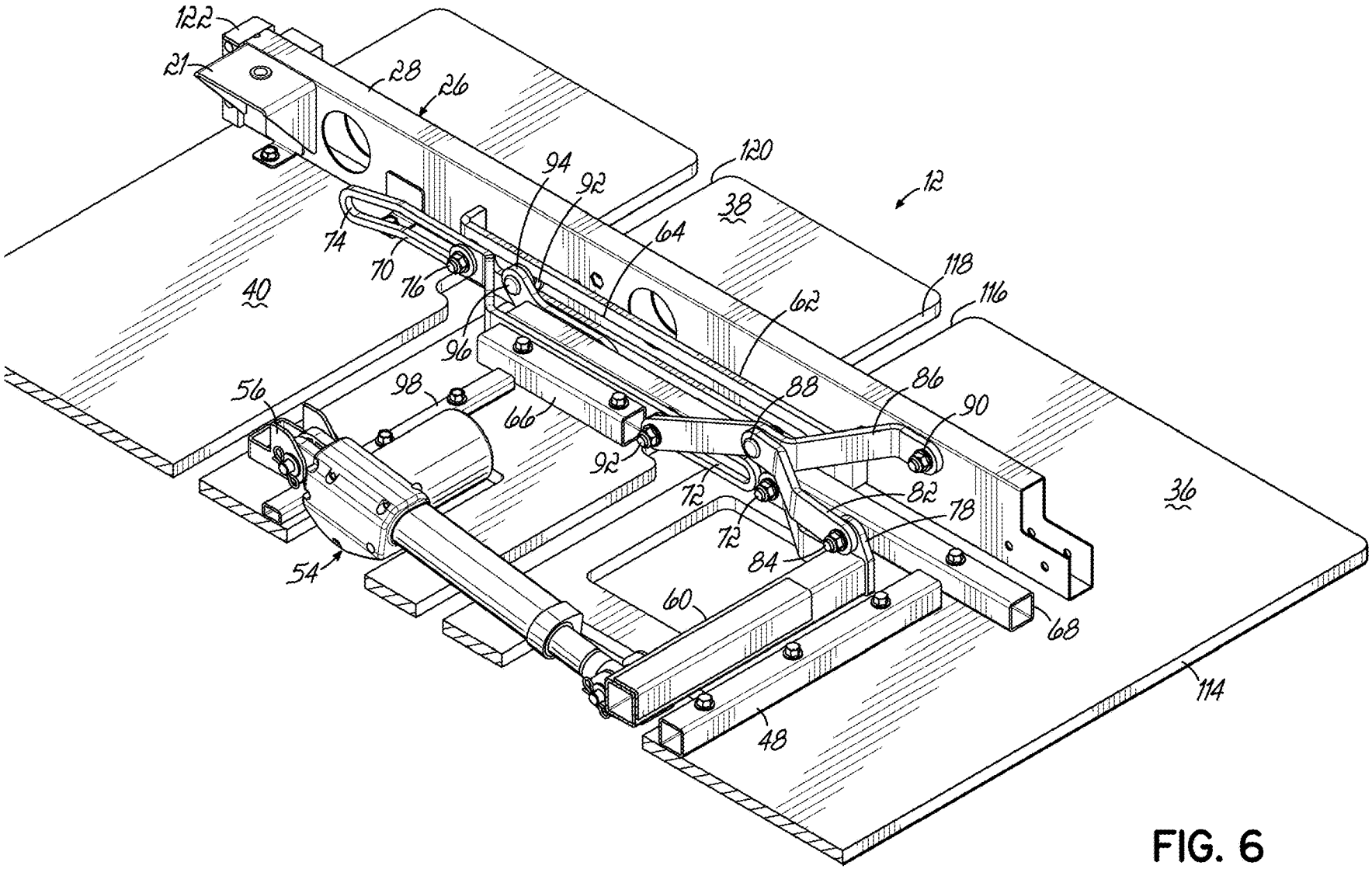
FIG. 6 is an enlarged perspective view of a portion of the adjustable bed base of FIG. 1.

As best shown in FIGS. 5 and 6, the adjustable bed base 12 further comprises a slotted guide member 62 which is generally U-shaped and welded or otherwise secured to the front member 28 of one of the side rails 26. Each slotted guide member 62 has a linear or straight slot 64 extending therethrough and extending along a length of the slotted guide member 62.

Figure 4B:
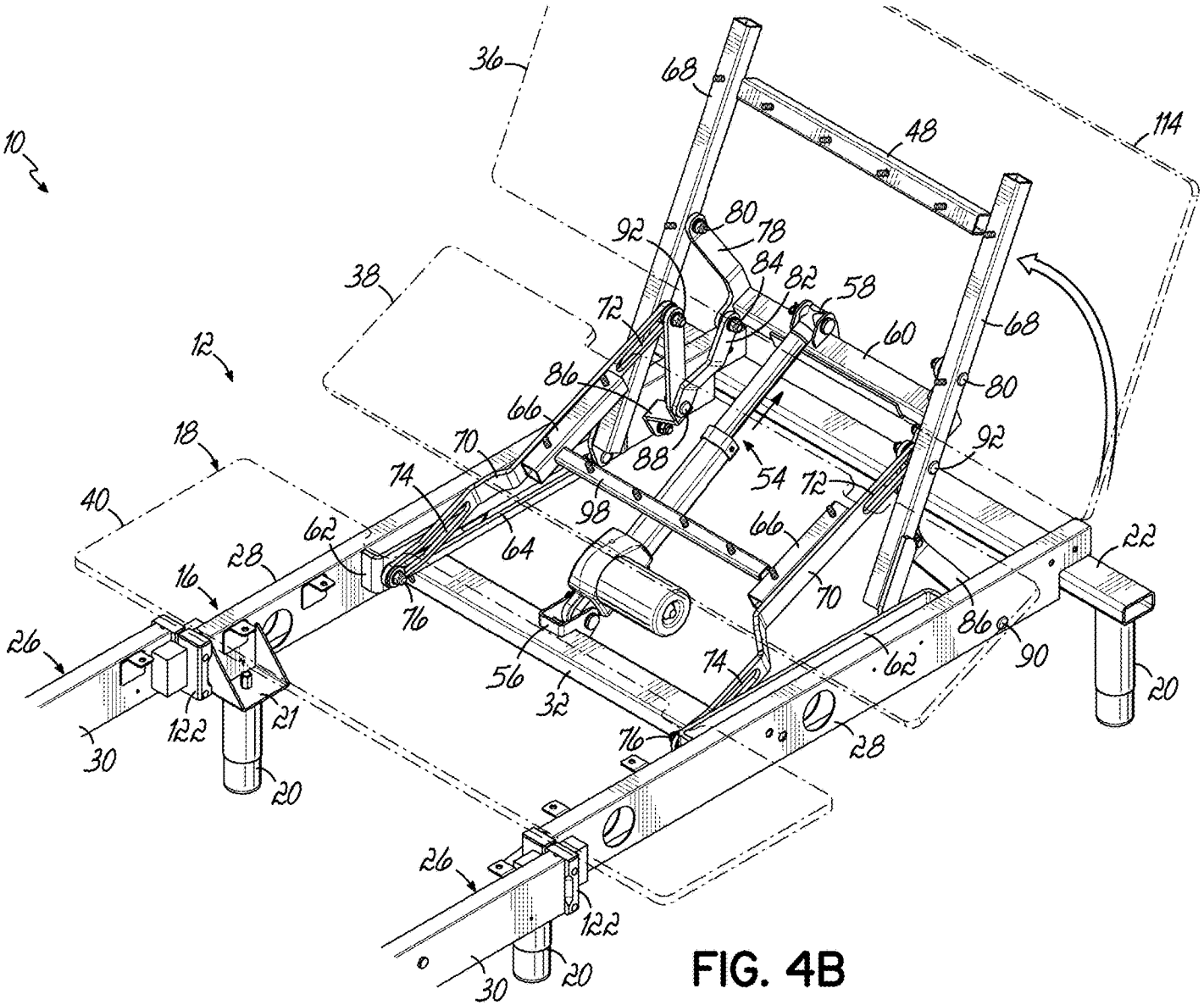
FIG. 4B is an enlarged perspective view of a portion of the adjustable bed base of FIG. 1.

As best shown in FIGS. 4A and 4B, the adjustable bed base 12 further comprises two spaced short tubes 66 secured to the inner head deck member 38. Each of the short tubes 66 extends generally parallel to the opposed front members 28 of the foldable side rails 26 and is under the inner head deck member 38.

As best shown in FIGS. 4A and 4B, the adjustable bed base 12 further comprises two spaced long tubes 68 secured to the outer head deck member 36. Each of the long tubes 68 extends generally parallel to the opposed front members 28 of the foldable side rails 26 and is under the outer head deck member 36.

As best shown in FIGS. 5 and 6, the adjustable bed base 12 further comprises two double slotted links 70, each one of the double slotted links 70 being welded or otherwise secured to one of the short tubes 66 secured to the lower head deck member 38. Each of the double slotted links 70 is outside one of the short tubes 66. Each of the double slotted links 70 has a front or first slot 72 and a rear or second slot 74. The front or first slot 72 is linear and the rear or second slot 74 is not linear. As best shown in FIG. 5, because each double slotted link 70 is welded to one of the short tubes 66, the two double slotted links 70, along with the two short tubes 66, move when the inner deck member 38 moves.

As best seen in FIG. 6, a stationary guide 76 is attached to each of the slotted guide members 62 and extends outwardly from the stationary guide 76 through the rear slot 74 of the double slotted link 70. As best shown in FIG. 6, the stationary guide 76 is located behind the linear slot 64 of the slotted guide member 62. As the double slotted link 70 moves with the short tubes 66 and inner head deck member 38, the stationary guide 76 moves along the rear slot 74 of the double slotted link 70. More specifically, during the inclination and forward movement of the inner head deck member 38 upon extension of the linear actuator 54, the stationary guide 76 moves rearwardly inside the rear slot 74 of the double slotted link 70.

As best shown in FIGS. 5 and 6, the adjustable bed base 12 further comprises a drive link 78 welded to each end of the drive tube 60. As best shown in FIGS. 4B and 5, each of the drive links 78 is pivotally secured at one end with a fastener 80 to one of the long tubes 68. Each of the drive links 78 is pivotally secured at its other end to a connecting link 82 with a fastener 84.

As best shown in FIGS. 5 and 6, each of the connecting links 82 has one end connected to one of the drive links 78 with a fastener 84 and a second end connected to a drag link 86 with a fastener 88. Each drag link 86 is pivotally connected at one end with a fastener 90 to one of the front members 28 of one of the side rails 26 of the stationary frame 18. The other end of each drag link 86 is pivotally secured to the double slotted link 70 with a riding fastener 92 which extends through the front slot 72 of the double slotted link 70.

As best shown in FIG. 5, the adjustable bed base 12 further comprises an extension link 94 welded or otherwise secured to each of the long tubes 68. As best seen in FIG. 5, one end of extension link 94 is secured to one of the slotted guide members 62 with an extension fastener 96. The extension fastener 96 passes through the linear slot 64 of the slotted guide member 62. As the long tubes 68 incline and move forwardly with the outer head deck member 36, the extension fasteners 96 move forwardly inside the linear slots 64 of the slotted guide members 62.

As best shown in FIGS. 4B and 5, the adjustable bed base 12 further comprises a first stabilizer 48 secured to the outer head deck member 36 of the articulating deck 34 and a second stabilizer 98 secured to the inner head deck member 38 of the articulating deck 34. Each of the stabilizers 48, 98 is bolted to its respective deck member on the underside thereof and functions to strengthen and stabilize the deck member to which it is secured. Each of the stabilizers 48, 98 moves with the respective head deck member 36, 38 to which it is bolted. It is not connected to any other elements of the adjustable bed base 12.

As best shown in FIGS. 3 and 4, the adjustable bed base 12 further comprises a rear pusher assembly 100 for moving (inclining or declining) the thigh and foot deck members 44, 46. The rear pusher assembly 100 comprises two links 102 connected by a cross member 104. Each of the links 102 has a first end to which a rotatable wheel 105 is rotatably secured.

As best shown in FIG. 4, the rear pusher assembly 100 of the adjustable bed base 12 further comprises a motorized rear linear actuator 106 for inclining the thigh and foot deck members 44, 46. The motorized rear linear actuator 106 has a rear or first end pivotally secured to a mounting bracket 108 secured to the rear rail 24 of the stationary frame 18. The motorized rear linear actuator 106 has a front or second end pivotally secured to a mounting bracket 110 secured to the cross member 104 of the rear pusher assembly 100. Although the mounting brackets 108, 110 are shown having certain shapes, either mounting bracket may be any other desired shape. Again, the drawings are not intended to be limiting. Although one form of rear pusher assembly is shown, any known mechanism may be used at the rear portion of the adjustable bed base to incline any number of members at the rear of the adjustable bed base.

As best shown in FIGS. 2 and 3, the adjustable bed base 12 further comprises a control box 112 which is shown secured to the stationary lower seat deck member 42. Although shown in one location, the control box 112 may be secured at any other desired location on the adjustable bed base 12 including being incorporated into one of the motorized linear actuators. Alternatively, the control box 112 may be located spaced from the adjustable bed base 12. The control box 112 is part of a control system which controls movement of the front linear actuator 54 and rear linear actuator 106.

FIGS. 7A-7D show different positions of the outer and inner head deck members 36, 38 of the adjustable bed base 12 due to the operation of the motorized front linear actuator 54. The drawings do not show the operation of the motorized rear linear actuator 106. More specifically, FIGS. 7A-7D show a method of raising an upper portion of the adjustable bed base 12 from a home position shown in FIG. 7A to a fully inclined position shown in FIGS. 7D and 8 using the motorized front linear actuator 54. For purposes of this document, the positions of the inner and outer deck members 38, 36 shown in FIGS. 7D and 8 will be called final positions.

Figure 7A:
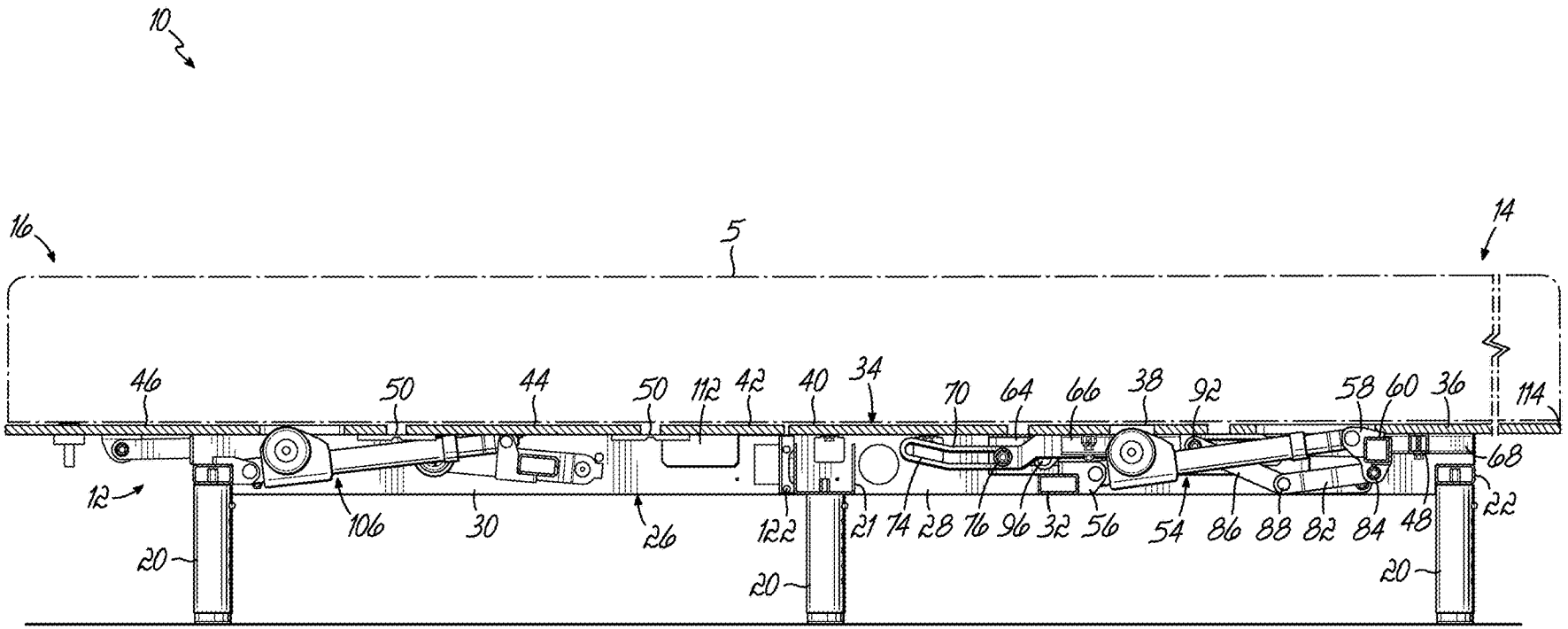
FIG. 7A is a side view, partially in cross-member, of the adjustable bed base of FIG. 1 in a home position.
Figure 7B:
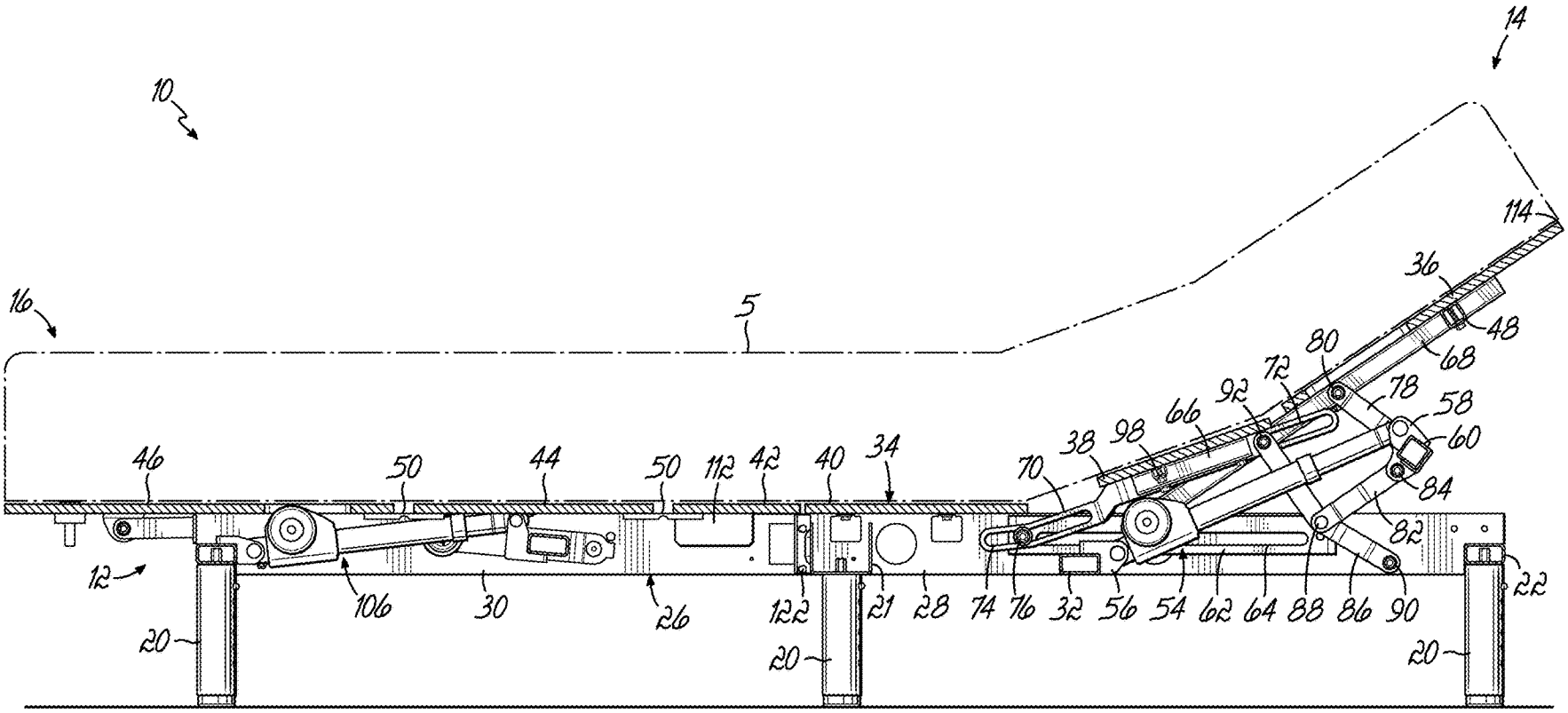
FIG. 7B is a side view, partially in cross-member, of the adjustable bed base of FIG. 1 showing the head deck members moving towards a fully inclined position.
Figure 7C:
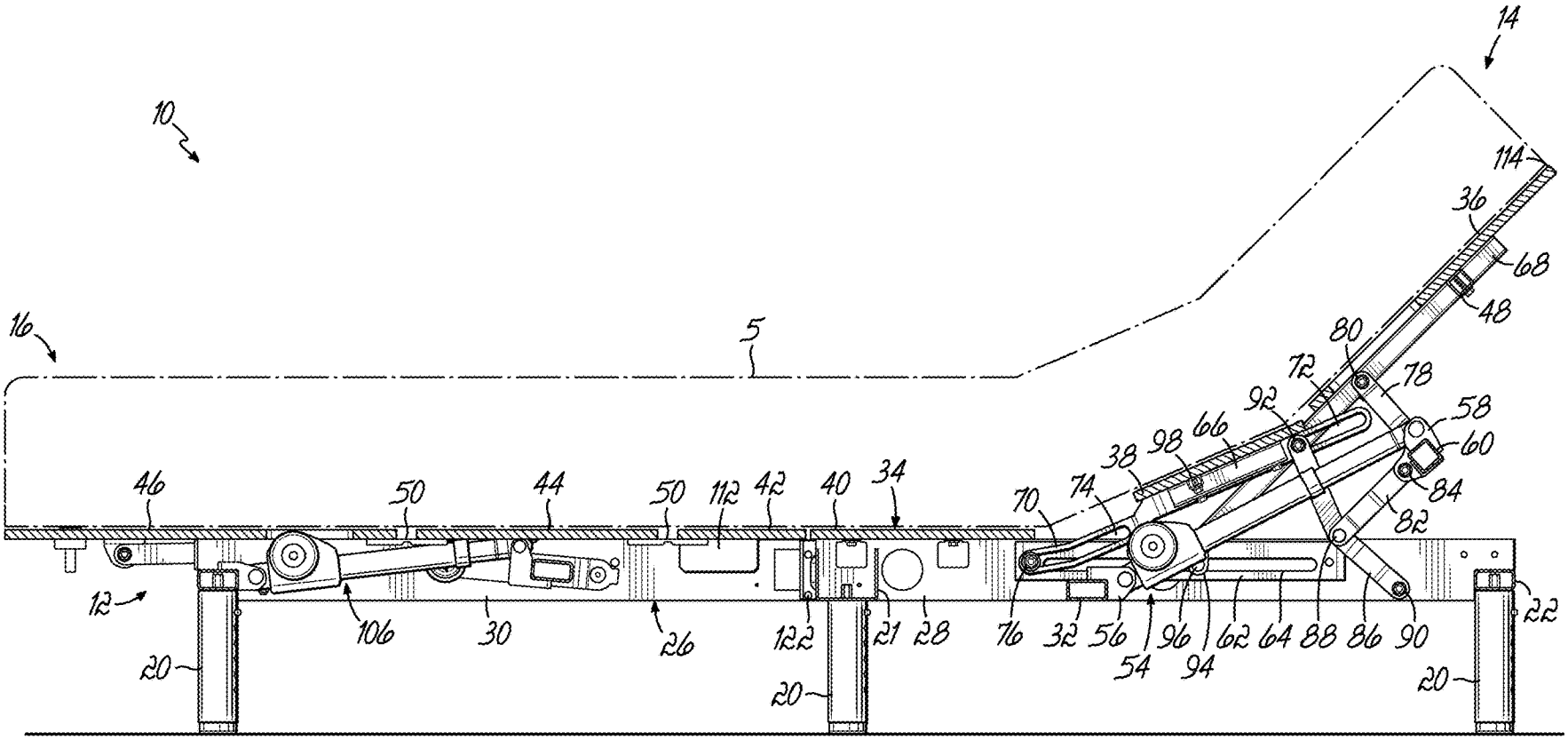
FIG. 7C is a side view, partially in cross-member, of the adjustable bed base of FIG. 1 showing the head deck members further moving towards their fully inclined positions.
Figure 7D:
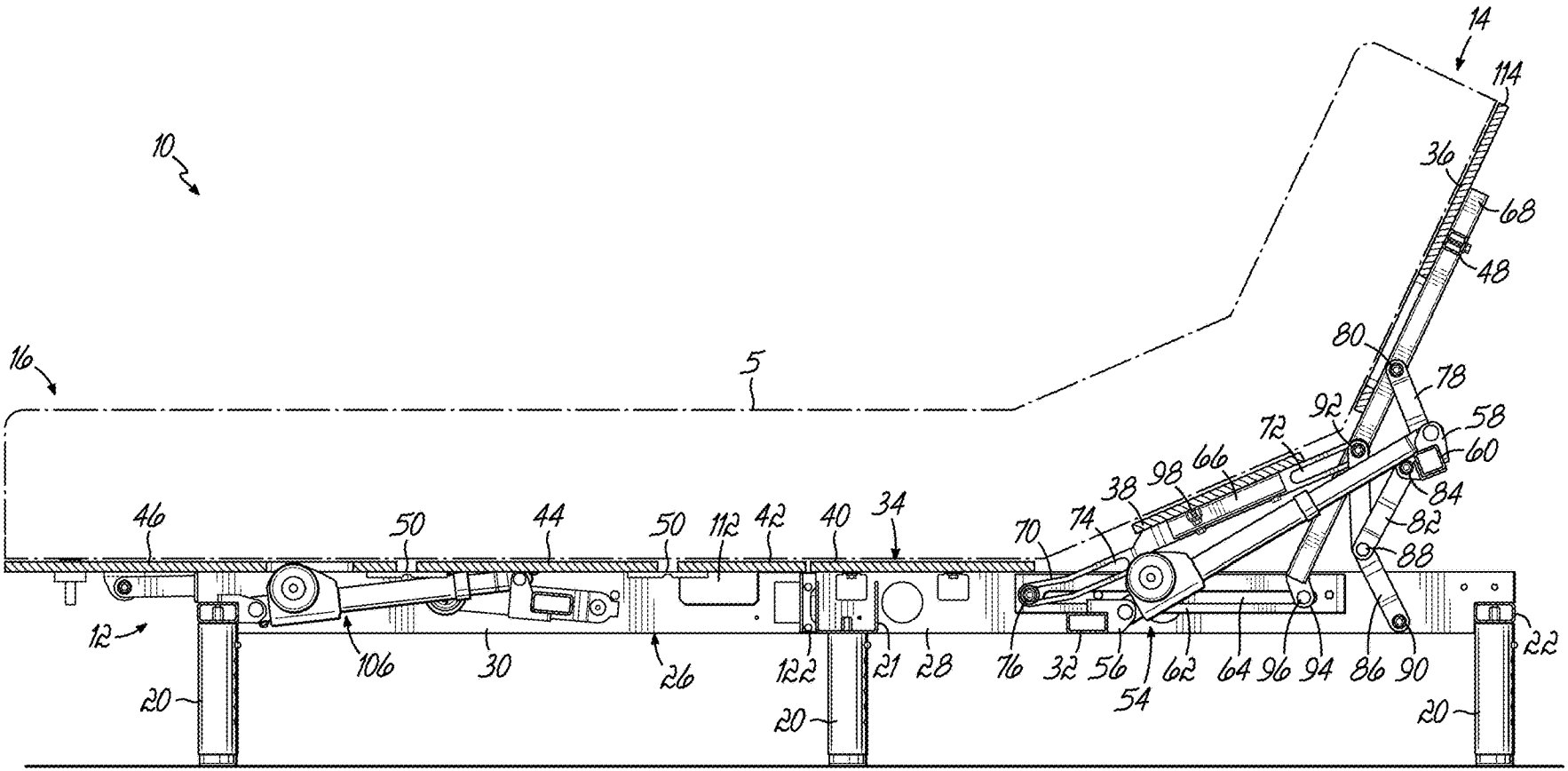
FIG. 7D is a side view, partially in cross-member, of the adjustable bed base of FIG. 1 showing the head deck members in their fully inclined positions.
Figure 7A:
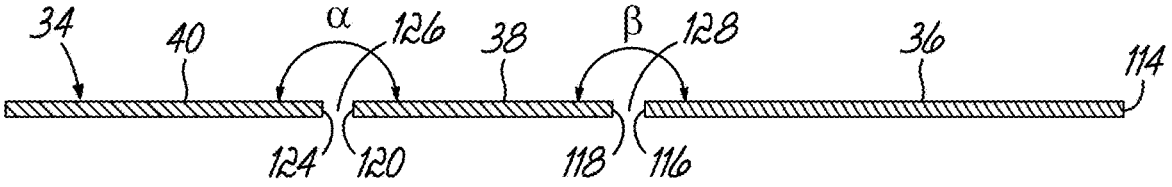
Figure 7B:
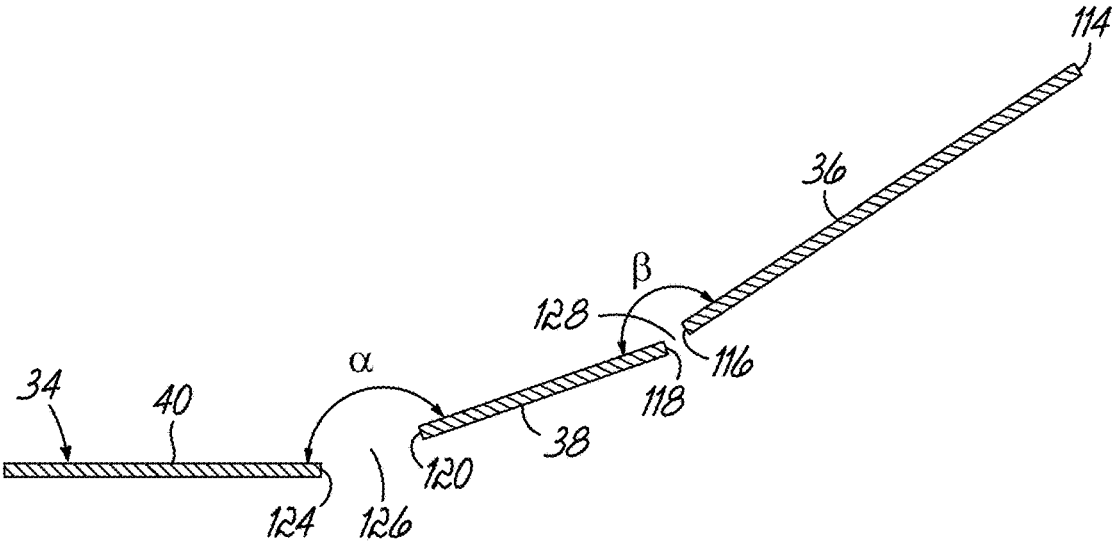
Figure 7C:
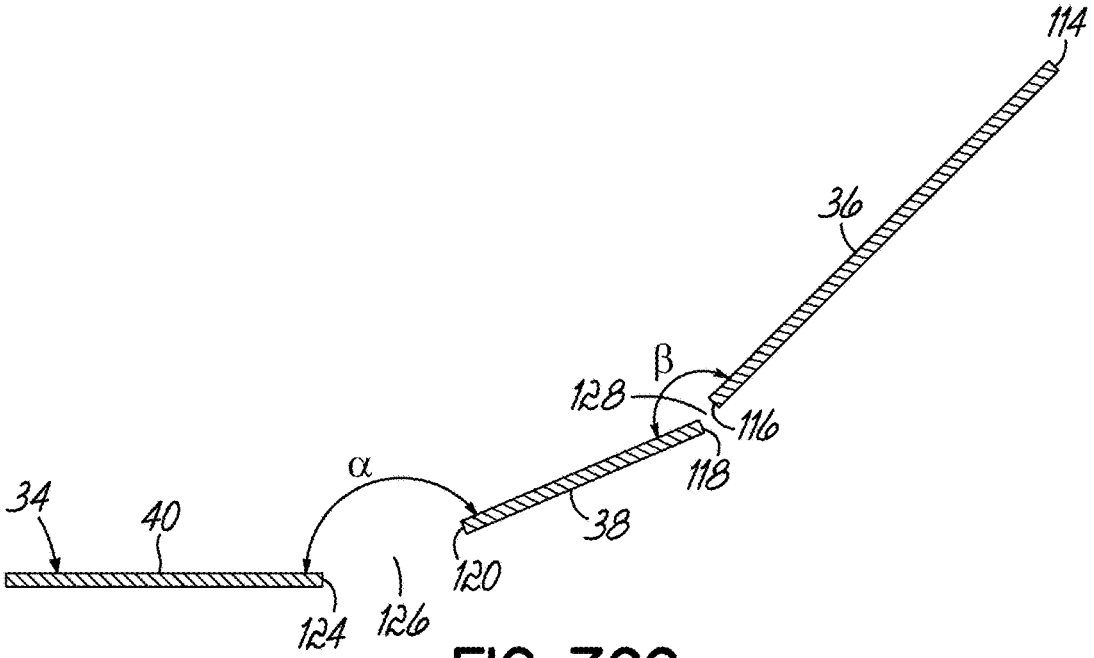
Figure 7D:
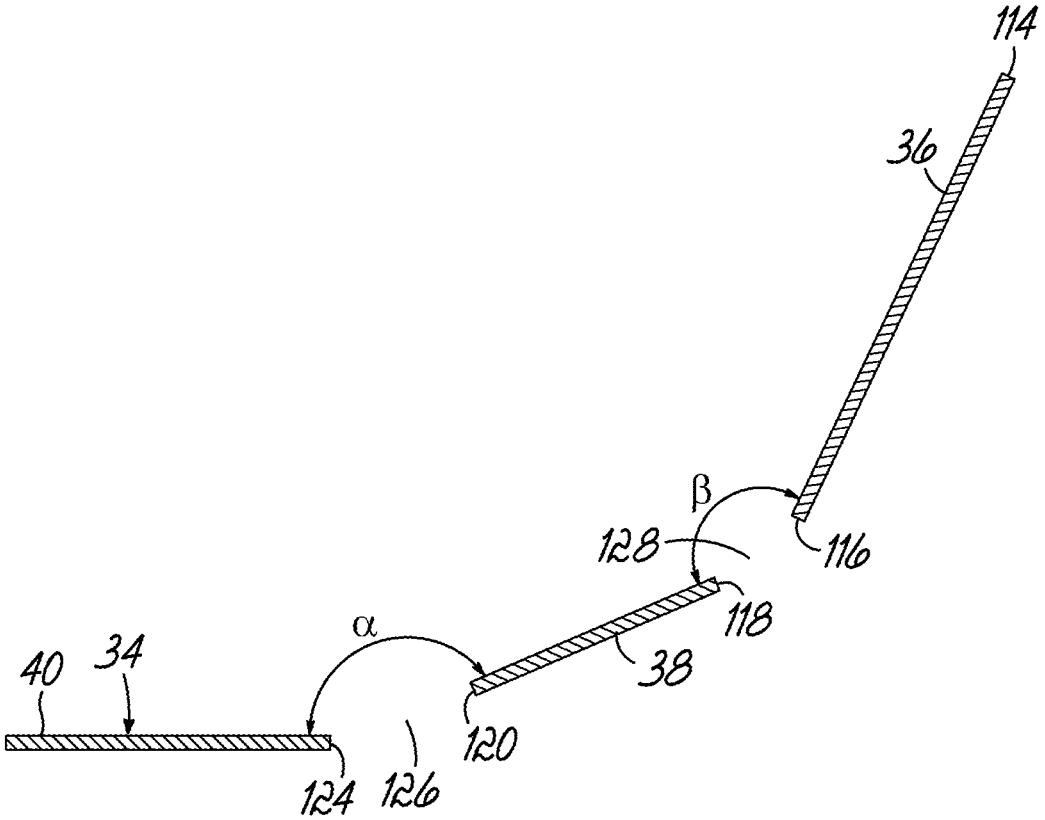
Figure 8:
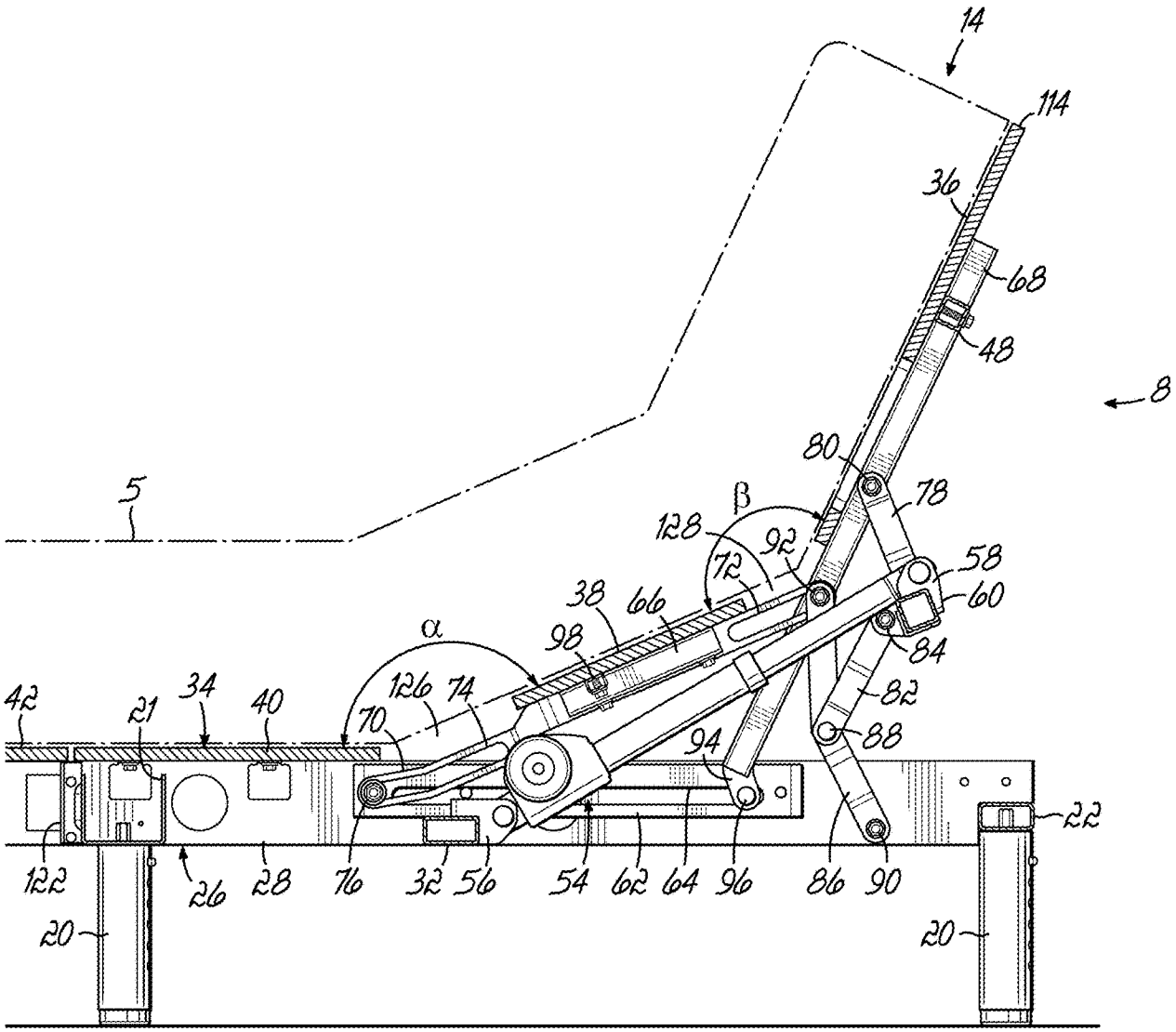
FIG. 8 is an enlarged side view, partially in cross-member, of the adjustable bed base of FIG. 1 showing the head deck members in their fully inclined positions.

As those skilled in the art will understand, the motorized front linear actuator 54 may retract as well as expand, thereby moving the upper portion of the adjustable bed base 12 from its fully inclined position shown in FIGS. 7D and 8 to its home position shown in FIG. 7A. With such retraction of the motorized front linear actuator 54, the inner and outer head deck members 38, 36 move from their final positions shown in FIGS. 7D and 8 to their home positions shown in FIG. 7A.

FIG. 7A shows the articulating deck 34 being flat with the deck members 36, 38, 40, 42, 44 and 46 being co-planar. FIG. 7A shows the adjustable bed base 12 in a home position with the deck members 36, 38, 40, 42, 44 and 46 being in a horizontal position. In this home position, the motorized front linear actuator 54 is either partially or fully retracted. From this home position shown in FIG. 7A, the motorized front linear actuator 54 of adjustable bed base 12 is activated via remote control (not shown) or an app on a phone (not shown) to expand or lengthen. In this home position, as best shown in FIG. 6, the extension fastener 96 extends through the linear slot 64 of the slotted guide member 62 and is located near the rear end of the linear slot 64. The riding fastener 92 extends through the front slot 72 of the double slotted link 70 and is located near the rear end of the front slot 72 of the double slotted link 70. Lastly, the stationary guide 96 extends through the rear slot 74 of the double slotted link 70 at the front end of the rear slot 74 of the double slotted link 70.

FIG. 7B shows the motorized front linear actuator 54 beginning to expand to start the inclination of the outer and inner head deck members 36, 38 such that a front edge 114 of the outer head deck member 36 is above a rear edge 116 of the outer head deck member 36. This initial expansion of the motorized front linear actuator 54 inclines the inner front deck member 38 such that a front edge 118 of the inner front deck member 38 is above a rear edge 120 of the inner front deck member 38. FIG. 7B shows the inner and outer head deck members 38, 36 in a first inclined position due to the extension of the motorized front linear actuator 54. During this initial expansion of the motorized front linear actuator 54, the double slotted links 70 incline and move forwardly with the inner head deck member 38, causing the stationary guides 96 to move rearwardly in the rear slots 74 of the double slotted links 70. The riding fasteners 92 remain in the same position as shown in FIG. 7A, located near the rear end of the front slots 72 of the double slotted links 70. During this initial expansion of the motorized front linear actuator 54, the long links 68 incline and move forwardly with the outer head deck member 36, causing the extension fasteners 96 to begin to move forwardly inside the linear slots 64 of the slotted guide members 62. The extension fasteners 96 are not seen in FIG. 7B but are shown in FIG. 7C.

FIG. 7C shows the motorized front linear actuator 54 further expanding to continue the inclination and forward movement of the outer and inner head deck members 36, 38 relative to their first inclined positions shown in FIG. 7B. FIG. 7C shows the outer and inner head deck members 36, 38 in their second inclined positions due to further expansion of the motorized front linear actuator 54. This further expansion of the motorized front linear actuator 54 further inclines the outer head deck member 36 such that the front edge 114 of the outer head deck member 36 is further above a rear edge 116 of the outer head deck member 36 in its second inclined position shown in FIG. 7C than in its first inclined position shown in FIG. 7B. This further expansion of the motorized front linear actuator 54 further inclines the inner front deck member 38 such that the front edge 118 of the inner front deck member 38 is further above a rear edge 120 of the inner front deck member 38 in its second inclined position shown in FIG. 7C than in its first inclined position shown in FIG. 7B.

During this further expansion of the motorized front linear actuator 54, the double slotted links 70 move forward with the inner head deck member 38, causing the stationary guides 96 to move rearwardly in the rear slots 74 of the double slotted links 70 until the stationary guides 96 can't move any further inside the rear slots 74 of the double slotted links 70. The riding fasteners 92 remain in the same position as shown in FIG. 7A, located near the rear end of the front slots 72 of the double slotted links 70. During this further expansion of the motorized front linear actuator 54, the long links 68 move forward with the outer head deck member 36, causing the extension fasteners 96 to further move forwardly inside the linear slots 64 of the slotted guide members 62.

During this further expansion of the motorized front linear actuator 54 shown comparing FIGS. 7B and 7C, the spacing between a front edge 124 of the front seat deck member 40 and the rear edge of the inner head deck member 38 increases while the spacing between the front edge 118 of the inner front deck member 38 and the rear edge 116 of the outer head deck member 36 remains the same.

FIG. 7D shows the inner and outer head deck members 38, 36 in their fully inclined or final positions. FIG. 7D shows the motorized front linear actuator 54 further expanding to continue move the outer head deck member 36 forward relative to its position shown in FIG. 7C while the inner front deck member 38 remains in the same inclined position shown in FIG. 7C. This further expansion of the motorized front linear actuator 54 moves the outer head deck member 36 forwardly, causing the riding fasteners 92 to move forwardly in the front slots 72 of the double slotted links 70 until the riding fasteners 92 can't move any further inside the front slots 72 of the double slotted links 70. The extension fasteners 96 move forwardly from their positions shown in FIG. 7C until they reach the front ends of the linear slots 64 of the slotted guide members 62. During this forward movement of the extension fasteners 96 inside the front slots 72 of the double slotted links 70, the extension fasteners 96 simultaneously move forward inside the linear slots 64 of the slotted guide members 62. The length of the linear slots 64 of the slotted guide members 62 allows such additional movement of the extension links 94 and long tubes 68 which moves the outer head deck member 36 into a more vertical position than shown in FIG. 7C and further spaced forwardly from the inner head deck member 38.

During this further expansion of the motorized front linear actuator 54 shown comparing FIGS. 7C and 7D, the spacing between the front edge 124 of the front seat deck member 40 and the rear edge of the inner head deck member 38 remains the same while the spacing between the front edge 118 of the inner front deck member 38 and the rear edge 116 of the outer head deck member 36 increases.

FIG. 8 shows an enlarged side view of a head portion 8 of the adjustable bed base 12 showing the motorized front linear actuator 54 in a fully extended position. As shown in FIG. 8, when the motorized front linear actuator 54 is fully extended, the inner deck member 38 forms an angle $\alpha$ with the front seat deck member 40 and the inner deck member 38 forms an angle $\beta$ with the outer head deck member 40. When the motorized front linear actuator 54 is fully extended, the angle $\alpha$ is greater than the angle $\beta$.

As shown in FIG. 7AA, the angles $\alpha$ and $\beta$ are each 180 degrees when the inner and outer head deck members 38, 36 are in their home positions and the deck is flat. As best shown in FIG. 7BB, the angles $\alpha$ and $\beta$ are each less than 180 degrees, but not the same, when the inner and outer deck members 38, 36 are partially inclined. The angle $\beta$ is greater than the angle $\alpha$ in FIGS. 7B and 7BB.

As best shown in FIG. 7CC, the angles $\alpha$ and $\beta$ are each less than 180 degrees, but not the same, when the inner and outer deck members 38, 36 are further inclined than shown in FIGS. 7B and 7BB. The angle $\beta$ is greater than the angle $\alpha$ in FIGS. 7C and 7CC.

As best shown in FIG. 7DD, the angles $\alpha$ and $\beta$ are each less than 180 degrees, but not the same, when the inner and outer deck members 38, 36 are full inclined and in their final positions. The angle $\beta$ is greater than the angle $\alpha$ in FIGS. 7D and 7DD.

For purposes of this document, the spacing between the front edge 124 of the front seat deck member 40 and the rear edge of the inner head deck member 38 will be considered a first gap 126. The spacing between a front edge 116 of the outer head deck member 36 and the rear edge of the inner head deck member 38 will be considered a second gap 128. During the initial expansion of the motorized front linear actuator 54 shown comparing FIGS. 7A and 7B, the first gap 126 increases while the second gap 128 does not. During further expansion of the motorized front linear actuator 54 shown comparing FIGS. 7B and 7C, the first gap 126 further increases while the second gap 128 does not. During final expansion of the motorized front linear actuator 54 shown comparing FIGS. 7C and 7D, the first gap 126 remains the same while the second gap 128 increases in size.

Figure 9:
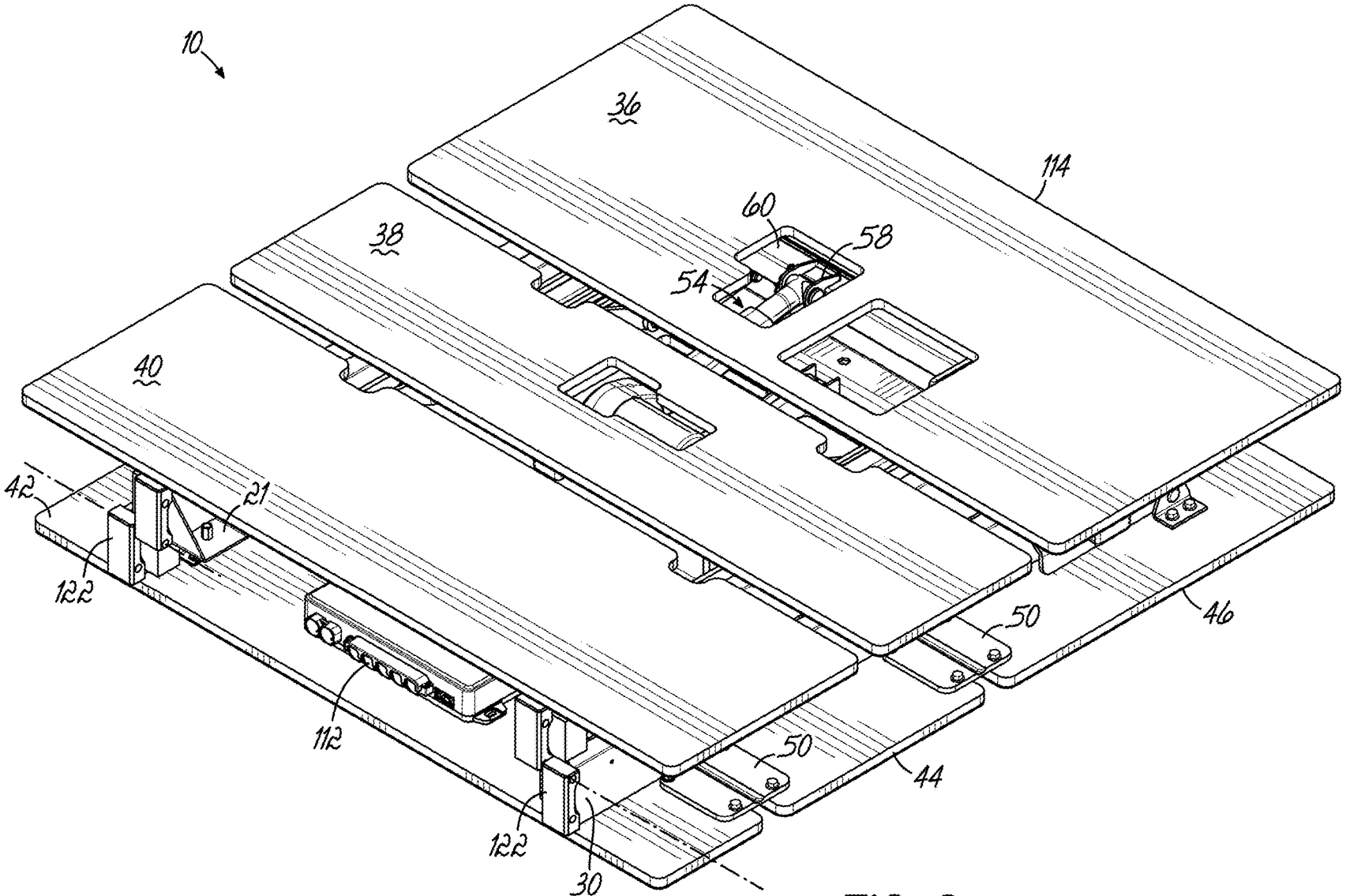
FIG. 9 is a top perspective view of the adjustable bed base of FIG. 1 in a folded position.
Figure 10:
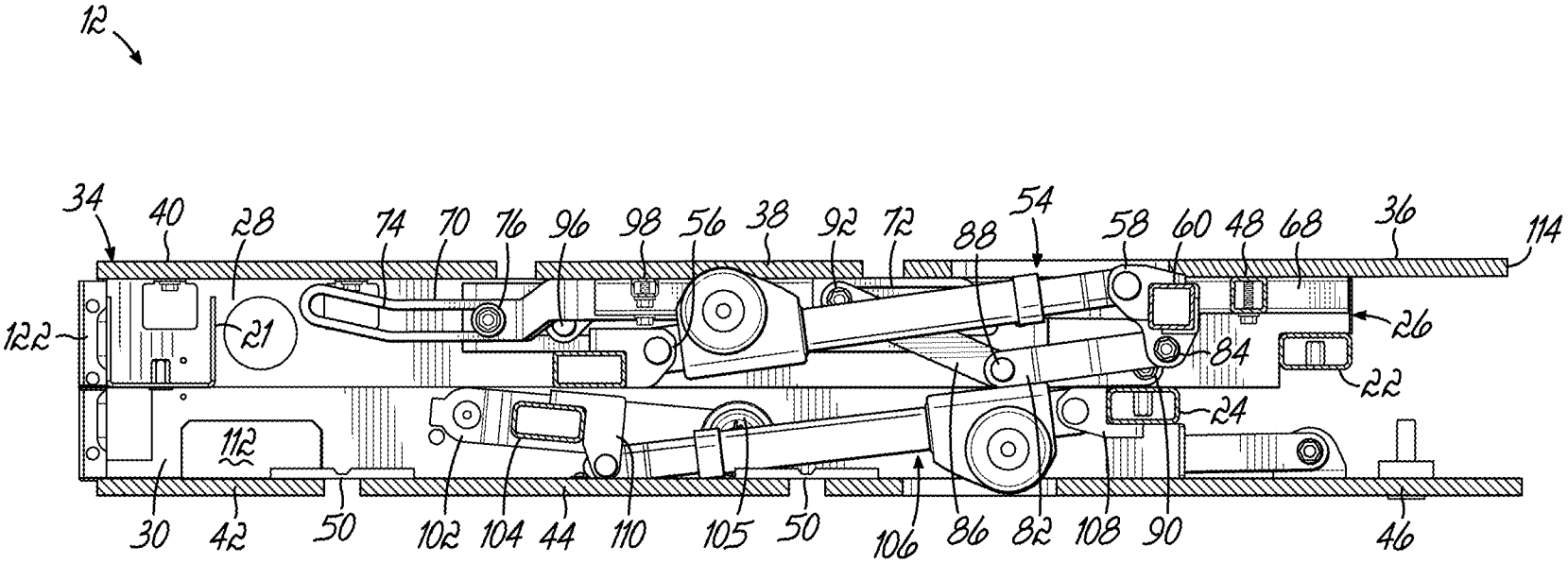
FIG. 10 is a side view of the adjustable bed base of FIG. 1 in a folded position.

FIGS. 9 and 10 show the adjustable bed base 12 in a folded or collapsed position using the hinges 122 of the side rails 26.

FIG. 11 illustrates an alternative embodiment of adjustable bed base 12*a* having a generally rectangular stationary frame 18*a* comprises a head rail 22, a foot rail 24 and two opposed side rails 26*a*. The side rails 16*a* are not hinged in this embodiment. All other components of the adjustable bed base 12*a* are identical to those of adjustable bed base 12 with like numbers being used for like parts.

For purposes of this document, the term "tube" is not intended to be limited to any dictionary definition. For example, the short tubes 66 and long tubes 68 of the present invention are rectangular in cross-member but may be circular in cross-member.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. An adjustable bed base comprising:

a generally rectangular stationary frame having opposed side rails, a head rail, and a foot rail;

a cross rail extending between the opposed side rails of the stationary frame, a slotted guide member secured to each of the side rails of the stationary frame, each slotted guide member having a slot extending along a length thereof;

an articulating deck comprising an outer head deck member, an inner head deck member and a seat deck member, the seat deck member being secured to the stationary frame;

two spaced short tubes secured to the inner head deck member and extending parallel the side rails of the stationary frame;

two spaced long tubes secured to the outer head deck member and extending parallel the side rails of the stationary frame;

a double slotted link secured to each of the short tubes, each double slotted link having a front slot and a rear slot;

a stationary guide secured to each of the slotted guide members and extending through the slot of the slotted guide member and through the rear slot of the double slotted link;

a linear actuator for moving the outer and inner head deck members, the linear actuator being secured to a first mounting bracket secured to the cross rail at one end and being secured to a second mounting bracket secured to a drive tube at a second end;

a drive link welded to each end of the drive tube, a first end of the drive link being pivotally secured to a connecting link and a second end of the drive link being pivotally secured to the long tube;

a drag link pivotally secured at a first end to one of the side rails of the stationary frame and secured to the double slotted link with a riding fastener which extends through the front slot of the double slotted link;

an extension link pivotally secured to one of the slotted guide members with an extension fastener which extends through the slot of the slotted member, the extension link being secured to one of the long tubes;

wherein the connecting link has a first end secured to the first end of the drive link and a second end secured to the drag link;

a control system which controls movement of the front linear actuator.

2. The adjustable bed base of claim 1, wherein the drive tube is shorter than the linear distance between the side rails of the stationary frame and extends parallel the head and foot rails of the stationary frame.

3. The adjustable bed base of claim 1, further comprising a first stabilizer secured to the outer head deck member between the long tubes and a second stabilizer secured to the inner head deck member between the short tubes.

4. The adjustable bed base of claim 1, wherein the long tubes extend parallel the side rails of the stationary frame.

5. The adjustable bed base of claim 1, wherein the drive links are non-linear.

6. The adjustable bed base of claim 1, wherein each slotted guide member is generally U-shaped and welded to one of the side rails of the stationary frame.

7. The adjustable bed base of claim 1, wherein the slot of each slotted guide member extends parallel the side rails of the stationary frame.

8. The adjustable bed base of claim 1, wherein the extension link is welded to one of the long tubes.

9. An adjustable bed base comprising:

a stationary frame having opposed side rails, a head rail, and a foot rail;

a cross rail extending between the opposed side rails of the stationary frame, a slotted guide member secured to each of the side rails of the stationary frame, each slotted guide member having a slot therethrough;

an articulating deck comprising an outer head deck member, an inner head deck member and a seat deck member, the seat deck member being secured to the stationary frame;

two spaced short tubes secured to the inner head deck member and extending parallel the side rails of the stationary frame;

two spaced long tubes secured to the outer head deck member and extending parallel the side rails of the stationary frame;

a double slotted link welded to each of the short tubes, each double slotted link having a first slot and a second slot;

a stationary guide secured to each of the slotted guide members and extending through the slot of the slotted guide member and through the second slot of the double slotted link;

a linear actuator for moving the outer and inner head deck members, the front linear actuator being pivotally secured to a first mounting bracket secured to the cross rail at one end and being pivotally secured to a second mounting bracket secured to a drive tube at a second end;

a drive link welded to each end of the drive tube, a first end of the drive link being pivotally secured to a connecting link and a second end of the drive link being pivotally secured to one of the long tubes;

a drag link pivotally secured at a first end to one of the side rails of the stationary frame and secured to the double slotted link with a riding fastener which extends through the first slot of the double slotted link; and an extension link pivotally secured to one of the slotted guide members with an extension fastener which extends through the slot of the slotted member, the extension link being welded to one of the long tubes, wherein the connecting link has a first end secured to the first end of the drive link and a second end secured to the drag link and wherein the double-slotted link, the drive link, the connecting link and the drag link are non-planar and non-linear.

10. The adjustable bed base of claim 9, further comprising a control system which controls movement of the linear actuator.

11. The adjustable bed base of claim 9, further comprising a first stabilizer secured to the outer head deck member between the long tubes and a second stabilizer secured to the inner head deck member between the short tubes.

12. The adjustable bed base of claim 11, wherein the drive tube is shorter than the linear distance between the side rails of the stationary frame and extends parallel the head and foot rails of the stationary frame.

13. The adjustable bed base of claim 9, wherein each slotted guide member is generally U-shaped and welded to one of the side rails of the stationary frame, the slot of each slotted guide member extending parallel the side rails of the stationary frame.

14. The adjustable bed base of claim 9, wherein the stationary guide secured to each slotted guide member is behind the slot of the slotted guide member.

15. The adjustable bed base of claim 9, wherein the control system includes a control box secured to the stationary seat deck member.

* * * * *